US005385820A

United States Patent [19]

Tanaka et al.

[11] Patent Number: 5,385,820

[45] Date of Patent: Jan. 31, 1995

[54] SILVER HALIDE PHOTOGRAPHIC LIGHT-SENSITIVE MATERIAL

[75] Inventors: Etuzi Tanaka; Motoshige Yamada; Akira Tanaka, all of Tokyo, Japan

[73] Assignee: Mitsubishi Paper Mills Limited, Tokyo, Japan

[21] Appl. No.: 235,243

[22] Filed: Apr. 29, 1994

Related U.S. Application Data

[63] Continuation of Ser. No. 51,830, Apr. 26, 1993, abandoned.

[30] Foreign Application Priority Data

Apr. 30, 1992 [JP] Japan ..... 4-111578

[51] Int. Cl.[6] ..... G03C 1/14; G03C 1/09

[52] U.S. Cl. ..... 430/595; 430/605

[58] Field of Search ..... 430/575, 595, 605

[56] References Cited

U.S. PATENT DOCUMENTS

| | | | |
|---|---|---|---|
| 4,452,882 | 6/1984 | Akimura et al. | 430/605 |
| 4,952,490 | 8/1990 | Takada et al. | 430/605 |
| 4,965,183 | 10/1990 | Mee et al. | 430/578 |
| 5,079,139 | 1/1992 | Bolger et al. | 430/595 |
| 5,079,490 | 1/1992 | Bolger et al. | 430/595 |

FOREIGN PATENT DOCUMENTS

| | | |
|---|---|---|
| 0138200 | 10/1984 | European Pat. Off. . |
| 0363104 | 4/1990 | European Pat. Off. . |
| 0363107 | 4/1990 | European Pat. Off. . |
| 63-106647 | 5/1988 | Japan . |
| 2161424 | 6/1990 | Japan . |
| 2203256 | 10/1988 | United Kingdom . |

*Primary Examiner*—Janet C. Baxter

*Attorney, Agent, or Firm*—Cushman, Darby & Cushman

[57] ABSTRACT

Disclosed is a silver halide photographic light-sensitive material which is high in sensitivity for high-intensity red light source and less in fog formation and excellent in time stability and comprises a support and at least one silver halide emulsion layer provided on the support wherein said silver halide emulsion comprises 50 mol % or more of silver chloride and contains $5\times10^{-9}$ mol or more of a water-soluble rhodium compound per 1 mol of silver and at least one sensitizing dye represented by the following formula (I), pH of said emulsion as finished being 4.8 or less:

(I)

wherein the symbols are as defined in the specification.

6 Claims, No Drawings

SILVER HALIDE PHOTOGRAPHIC LIGHT-SENSITIVE MATERIAL

This is a continuation of application No. 08/051,830, filed on Apr. 26, 1993, which was abandoned upon the filing hereof.

BACKGROUND OF THE INVENTION

The present invention relates to a silver halide photographic light-sensitive material and more particularly to a silver halide photographic light-sensitive material which is high in sensitivity and contrast and less in fogging for high intensity exposure to red light and is excellent in time stability of the emulsion.

With recent rapid progress of information transmission systems, the silver halide photographic light-sensitive materials are increasingly required to have the higher sensitivity. Examples of these systems are high-speed photo-composing system in which the information which is output from electronic computers is rapidly displayed as letters or figures by cathode-ray tubes and press facsimiles for rapid transmission of press manuscripts to remote places.

The characteristics required for the silver halide photographic light-sensitive materials used for such systems are high sensitivity, high contrast and high resolving power for so-called high-intensity and short-time exposure, namely, exposure for a short time of $10^{-4}$ second or less with a light source such as cathode ray tube (CRT), a gas laser such as argon or helium-neon or light emitting diode (LED). Among these light sources, the scanner system of argon laser has conventionally been mainly employed. This system can provide high output, but the apparatus is large-sized and expensive. Therefore, recently, apparatuses having the compact and inexpensive helium-neon laser or LED as the light source are sold from many companies and silver halide photographic light-sensitive materials high in sensitivity for these light sources are desired.

It is known to use trinuclear cyanines as sensitizing dyes in the case of exposure to such light sources of red light. These cyanines have a spectral absorption maximum in the region of about 600–680 nm and are very effective for sensitization to red light of helium-neon laser or LED. However, they tend to increase fog formation when added in a large amount. Use of antifoggants for inhibition of formation of fog causes deterioration in developability or reduction in sensitivity due to desorption of the dyes. If chemical sensitization is diminished, the sensitivity is insufficient and if the addition amount of the dye is increased, occurrence of fog further increases and retention of color of the dye increases to deteriorate the quality of images. Accordingly, there have been desired light-sensitive materials which are less in remaining of color of the dye, less in fogging and besides, high in sensitivity and contrast even when subjected to high-intensity exposure.

It is also known to add a water-soluble rhodium compound for preparing a high contrast silver halide photographic emulsion. However, when a silver halide emulsion prepared with addition of the said sensitizing dye and the rhodium compound in combination is coated on a photographic support, the sensitivity of the emulsion sometimes changes during the period of from the finishing of the emulsion until the coating of the emulsion or during the coating of the emulsion. Thus, there have been problems in stability in preparation of the emulsion and stability in quality of light-sensitive materials.

Consumption of silver halide photographic light-sensitive materials is increasing steadily and in many cases, the light-sensitive materials are processed in a short time at a high temperature for increasing the processing amount of the materials. Therefore, demand has more and more increased for light-sensitive materials which are high in sensitivity and less in formation of fog even when processed in a short time and at a high temperature and can give a certain photographic characteristics even if the processing conditions are somewhat deflected.

Silver iodobromide emulsions sensitized with gold and sulfur are widely known as emulsions having high sensitivity to high-intensity exposure. However, the light-sensitive materials coated with such emulsions sometimes show delay in developability or inferior clearing in fixation because of the short time development in processing of the film materials of a relatively large silver halide amount. Thus, demand for stability in processing of light-sensitive materials has further been increased.

SUMMARY OF THE INVENTION

The object of the present invention is to provide a silver halide photographic light-sensitive material which is high in sensitivity, less in formation of fog and high in contrast for red light sources of high intensity, excellent in time stability of the emulsion and high in processing stability.

The above object has been attained by providing a silver halide photographic light-sensitive material having at least one silver halide emulsion layer on a support, characterized in that said silver halide emulsion comprises 50 mol % or more of silver chloride and contains $5\times10^{-9}$ mol or more of a water-soluble rhodium compound per 1 mol of silver and at least one sensitizing dye represented by the following formula (I) and pH of said emulsion when finished is 4.8 or less:

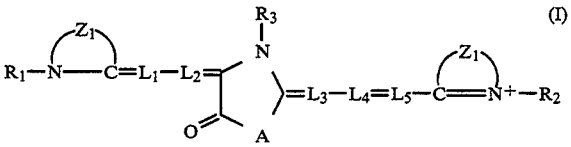

(I)

wherein $L_1$, $L_2$, $L_3$, $L_4$ and $L_5$ each represents a methine group, A represents O or S, $Z_1$ and $Z_2$ may be identical or different and each represents a group of non-metallic atoms necessary to complete a thiazole nucleus, a thiazoline nucleus, an oxazole nucleus or a selenazole nucleus, $R_1$ and $R_2$ each represents an alkyl group of 1 to 4 carbon atoms or an alkyl group of 1 to 4 carbon atoms which is substituted with an acid or an acid salt, $R_3$ represents an alkyl group of 1 to 6 carbon atoms which may be substituted with an acid group, an aryl group or a heterocyclic ring.

DESCRIPTION OF THE INVENTION

Typical examples of the sensitizing dyes represented by the formula (I) are shown below, which do not limit the sensitizing dyes used in the present invention.

(1)
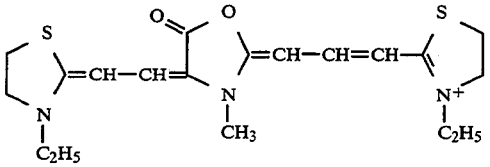
(2)
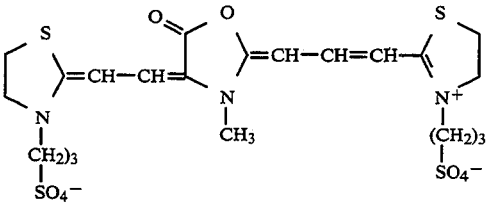
(3)
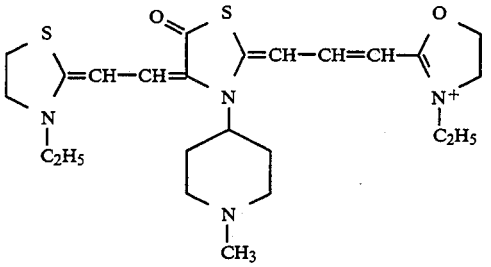
(4)
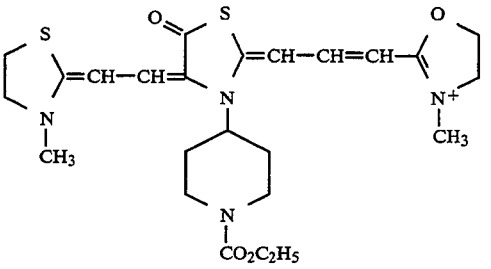
(5)
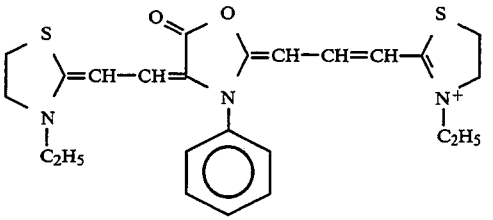
(6)
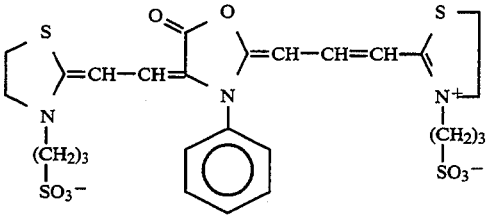
(7)
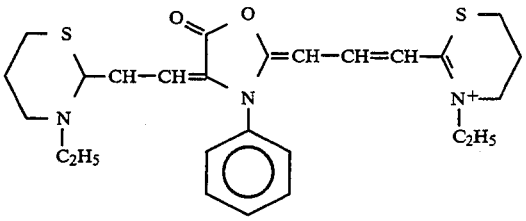
-continued
(8)
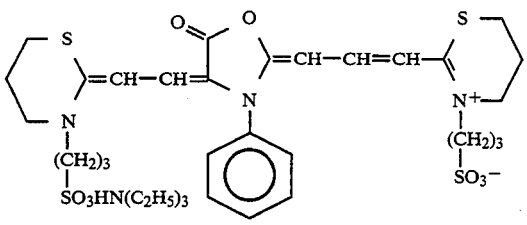
(9)
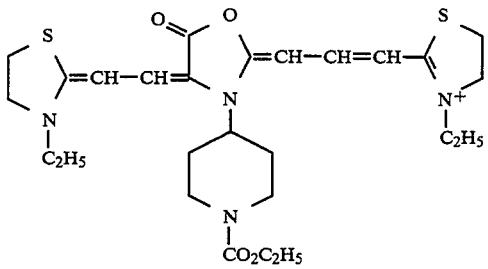
(10)
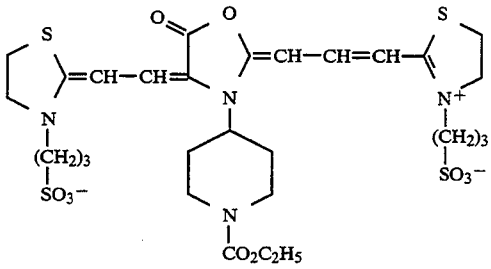
(11)
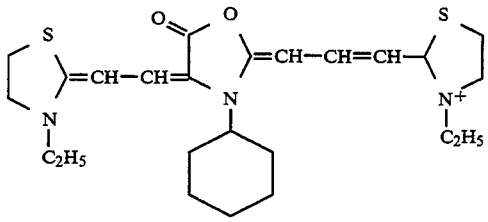
(12)
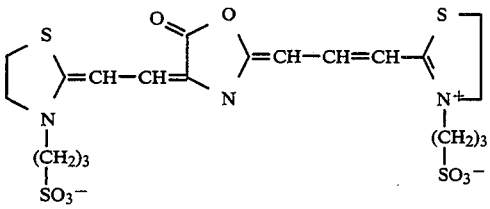
(13)
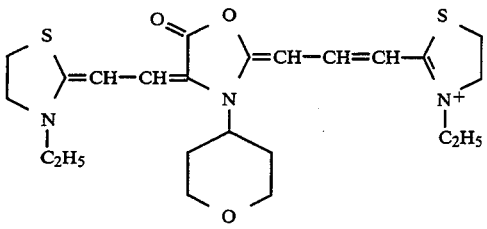

-continued (14)

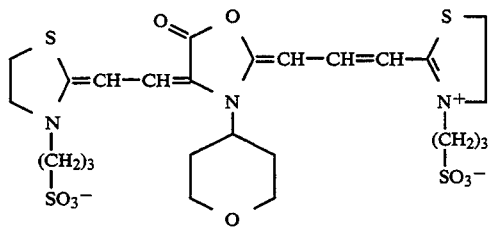

(15)

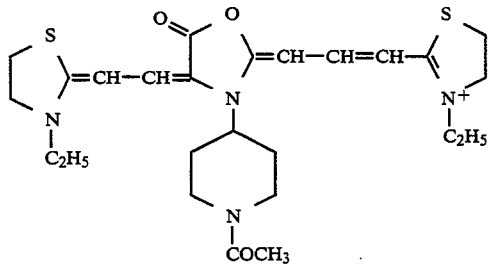

(16)

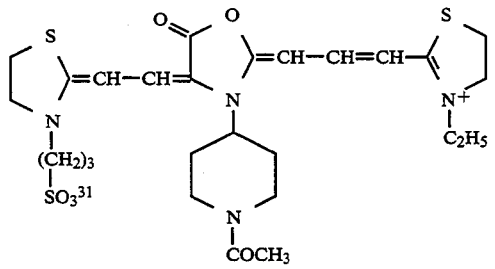

(17)

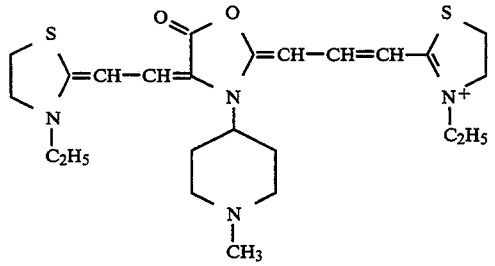

(18)

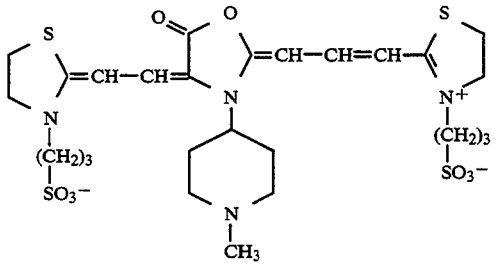

The sensitizing dye can be added to the silver halide emulsion as a solution in a single solvent or a mixed solvent selected from methanol, ethanol, isopropanol, pyridine, dimethylformamide, water and the like. The sensitizing dye can also be added to the emulsion by ultrasonic dispersion method. Furthermore, there may be used the methods as mentioned in U.S. Pat. Nos. 3,482,981, 3,585,195, 3,469,987, 3,649,286, 3,485,634, 3,334,605 and 2,912,343. Moreover, the sensitizing dye can be added to the silver halide emulsion at any time during the preparation of the emulsion. The amount of the sensitizing dye added may vary depending on the kinds of the sensitizing dye and the silver halide emulsion, but is normally in the range of 0.01–10 g per 1 kg of silver nitrate used in preparation of the emulsion.

As the water-soluble rhodium compound used in the present invention, mention may be made of, for example, rhodium monochloride, rhodium dichloride, rhodium trichloride and ammonium hexachlororhodate. Preferred are water-soluble trivalent rhodium compounds. The amount of these water-soluble rhodium compounds is $5.0\times10^{-9}$ mol or more, preferably $2\times10^{-8}$ to $1\times10^{-6}$ mol per 1 mol of the silver halide. When the amount of these water-soluble rhodium compounds is small, the tone of the silver halide photographic light-sensitive materials becomes soft and the high contrast cannot be obtained. The water-soluble rhodium compounds used in the present invention can be added during either the physical ripening or the chemical ripening of the emulsion and it is preferred to add them during the physical ripening.

In order to adjust the pH of the emulsion to 4.8 or lower in the present invention, it is preferred to add an acid to the emulsion. The acid used for adjustment of the pH may be organic acids such as acetic acid, citric acid, phthalic acid and salicylic acid or inorganic acids such as hydrochloric acid, sulfuric acid, nitric acid and perchloric acid.

The silver halide emulsion used in the present invention is silver chloride, silver chlorobromide or silver chloroiodobromide and contains at least 50 mol % of silver chloride grains. When the content of silver chloride is less than 50 mol %, the development progressiveness and the fixing rate decrease and such silver halide emulsion is not suitable for the rapid processing. The higher silver chloride content is desirable and 70 mol % or more is preferred.

The silver halide emulsion of the present invention is chemically sensitized with sulfur+gold. As the sulfur sensitizers, there may be used various sulfur compounds such as thiosulfates, thioureas, thiazoles and rhodanines as well as sulfur compounds contained in gelatin. The gold sensitizers include various gold salts such as chloroauric acid, trichloroauric acid and thiocyanatoauric acid.

Salts of metals such as iridium can be added during physical ripening or chemical ripening of the silver halide. It is also possible to sensitize the photographic emulsion with quaternary ammonium salts, thioether compounds, polyethylene oxide derivatives, diketones or the like. These methods are mentioned in U.S. Pat. Nos. 2,708,162, 3,046,132, 3,046,133, 3,046,134 and 3,046,135 and British Patent No. 939,357.

Various hydrophilic colloids are used for the photographic light-sensitive materials of the present invention. As the hydrophilic colloids used as vehicles for photographic emulsions and/or other photographic constituting layers, mention may be made of, for example, gelatin, colloidal albumin, casein, cellulose derivatives such as carboxymethyl cellulose and hydroxyethyl cellulose, sugar derivatives such as agar, sodium alginate and starch derivatives, and synthetic hydrophilic colloids such as polyvinyl alcohol, poly-N-vinylpyrrolidone, polyacrylamide and derivatives or partial hydrolyzates thereof. If necessary, there may be used compatible mixtures of two or more of these colloids. Among them, gelatin is most commonly used and a part or the whole of the gelatin can be replaced with a synthetic polymeric substance. In addition, it may be replaced with so-called gelatin derivatives, namely, products obtained by treating and modifying amino group, imino group, hydroxy group or carboxyl group contained as a functional group contained in the molecule with a reagent having one group reactable with said functional group or graft polymers which have a molecular chain of other polymeric substance grafted thereon.

The photographic emulsion layer and other hydrophilic colloid layers of the photographic light-sensitive materials of the present invention may contain inorganic or organic hardeners. Examples of the hardeners are chrominum salts such as chromium alum and chromium acetate; aldehydes such as formaldehyde, glyoxal and glutaraldehyde; N-methylol compounds such as dimethylolurea and methyloldimethylhydantoin; dioxane derivatives such as 2,3-dihydroxydioxane; active vinyl compounds such as 1,3,5-triacryloyl-hexahydro-S-triazine and 1,3-vinylsulfonyl-2-propanol; active halogen compounds such as 2,4-dichloro-6-hydroxy-S-triazine; and mucohalogenic acids such as mucochloric acid and mucophenoxychloric acid. These may be used each alone or in combination.

The photographic emulsion layer and other hydrophilic colloid layers of the photographic light-sensitive materials of the present invention may contain surface active agents for various purposes such as coating aid, antistatic purpose, improvement of slippage, emulsification and dispersion and anti-sticking.

Examples of the surface active agents are nonionic surface active agents such as saponins (steroid type), alkylene oxide derivatives such as polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkyl amines or amides and polyethylene oxide adducts of silicone, glyoxydol derivatives such as alkenylsuccinic acid polyglycerides and alkylphenol polyglycerides, fatty acid esters of polyhydric alcohols and alkyl esters of sugars; anionic surface active agents having carboxyl group, sulfo group, phospho group, sulfate ester group or phosphate ester group such as alkylcarboxylates, alkylsulfonates, alkylbenzenesulfonates, alkylnaphthalenesulfonates, alkylsulfates, alkylphosphates, N-acyl-N-alkyltaurines, sulfosuccinates and sulfoalkylpolyoxyethylenealkylphosphates; amphoteric surface active agents such as amino acids, aminoalkylsulfonic acids, aminoalkylsulfates or phosphates, alkylbetaines and amine oxides; and cationic surface active agents such as alkylamine salts, aliphatic or aromatic quaternary ammonium salts, heterocyclic quaternary ammonium salts such as pyridium and imidazolium and aliphatic phosphonium or sulfonium salts or phosphonium or sulfonium salts containing heterocyclic ring. Furthermore, it is also possible to add latex polymers to modify the properties of the gelatin film or to add silica, starch powders, colloidal silica or glass powders to mat the light-sensitive materials.

Various compounds can be contained in the photographic emulsion layer or other hydrophilic colloid layers in order to inhibit the formation of fog during production, storage or photographic processing of the light-sensitive materials or to stabilize the photographic performances. That is, there may be added various compounds known as antifoggants or stabilizers, for example, azoles such as benzothiazolium salts, nitroindazoles, triazoles, benzotriazoles and benzimidazoles (especially, nitro- or halogen-substituted ones); heterocyclic mercapto compounds such as mercaptothiazoles, mercaptobenzothiazoles, mercaptobenzimidazoles, mercaptothiadiazoles, mercaptotetrazoles (especially, 1-phenyl-5-mercaptotetrazole) and mercaptopyrimidines; the above heterocyclic mercapto compounds which have a water-soluble group such as carboxyl group or sulfone group; thioketo compounds such as oxazolinethione; azaindenes such as tetrazaindenes (especially, 4-hydroxy-substituted (1,3,3*a*, 7)tetrazaindene); benzenethiosulfonic acids; and benzenesulfinic acid.

The light-sensitive materials of the present invention may further contain other compounds such as antistatic agents, antihalation dyes, plasticizers, developing agents, ultraviolet absorbers, fluorescent dyes, developing accelerators and couplers.

Any supports generally used for photographic light-sensitive materials can be used for the light-sensitive materials of the present invention. Examples of these supports are cellulose nitrate film, cellulose acetate film, cellulose acetate butyrate film, cellulose acetate propionate film, polystyrene film, polyethylene terephthalate film, polycarbonate film and laminates of these films, and paper. Papers coated or laminated with baryta or $\alpha$-olefin polymers, especially those which have 2–10 carbon atoms, such as polyethylene and polypropylene and plastic films improved in adhesion to other polymers by toughening the surface as mentioned in Japanese Patent Kokoku No. 47-19068 are also suitable as the supports.

The hydrophilic colloid layers of the present invention can be coated by air doctor coating, blade coating, squeeze coating, air knife coating, reverse-roll coating, cast coating, extrusion coating and others. The coating amount of the hydrophilic colloid layers is preferably 1–15 $\mu$m, more preferably 2–10 $\mu$m.

The following examples are set forth for purpose of illustration. It should be understood that they are exemplary only, and should not be construed as limiting the invention in any manner.

EXAMPLE 1

Preparation of emulsion:

An aqueous solution containing 5 g of sodium chloride and 40 g of gelatin in 600 ml of water was mixed with an aqueous silver nitrate solution and a halogen solution containing water-soluble iridium salt ($3.25\times10^{-6}$ mol per 1 mol of silver) and potassium hexachlororhodate (in an amount as shown in Tables 1–3 per 1 mol of silver) in accordance with the double-jet method where pAg was controlled to 8.6 to at 40° C. to prepare a silver chlorobromide (30 mol % of silver bromide) emulsion of 0.25 $\mu$m in average grain size. To the emulsion was added a potassium iodide (0.1 mol % based on silver) solution, followed by precipitation, washing with water and redissolution. The resulting emulsion was divided into 48 equal parts, which were subjected to sulfur+gold sensitization at 55° C. At this time, the dye shown in Tables 1–3 was added in an amount of $1.6\times10^{-4}$ mol per 1 mol of the silver halide and the emulsions were subjected to dye ripening and then cooled to 40° C. To these emulsions were added 1-phenyl-5-mercaptotetrazole, 2,4-dichloro-6-hydroxytriazine, phenoxypolyethylene glycol surface active agent, hydroquinone and water-soluble latex. These emulsions were adjusted to the pH as shown in Tables 1–3 to obtain finished emulsions. Each of these emulsions as finished was coated at a coating amount of 4.1 g/m$^2$ in terms of silver on a polyester film together with a protective layer (gelatin 1.5 g/m$^2$) to prepare samples. For evaluation of the time stability of the emulsions, the emulsions as finished were kept at 37° C. for 12 hours and each of the emulsions was coated in the same manner as above. These samples were subjected to sensitometric exposure through an interference filter of 633 nm for $10^{-4}$ second, developed with PQ developer, fixed, washed with water and dried and the characteristics were obtained. The results are shown in Tables 1–3. The sensitivity is shown as relative value when the sensitivity of the sample which was prepared using the emulsion containing no water-soluble rhodium compound and having a pH of 5.5 at the time of being coated and which had a dye density of 4.0 just after preparation was regarded to be 100.

TABLE 1

| Sample No. | Amount of rhodium compound ($\times 10^{-8}$ mol) | Sensitizing dye | pH of emulsion as finished | Just after preparation of emulsion | | | 12 hours after preparation of emulsion | | | |
|---|---|---|---|---|---|---|---|---|---|---|
| | | | | Sensitivity | Fog | γ | Sensitivity | Fog | γ | |
| 1 | 0 | (4) | 5.5 | 100 | 0.07 | 4.2 | 88 | 0.19 | 3.1 | |
| 2 | " | " | 5.0 | 100 | 0.07 | 4.2 | 90 | 0.15 | 3.2 | |
| 3 | " | " | 4.8 | 100 | 0.07 | 4.3 | 98 | 0.10 | 3.8 | |
| 4 | " | " | 4.5 | 100 | 0.07 | 4.2 | 99 | 0.09 | 3.9 | |
| 5 | 0.1 | " | 5.5 | 98 | 0.07 | 5.5 | 70 | 0.18 | 3.9 | |
| 6 | " | " | 5.0 | 97 | 0.07 | 5.5 | 75 | 0.16 | 4.2 | |
| 7 | " | " | 4.8 | 97 | 0.07 | 5.6 | 93 | 0.10 | 5.0 | |
| 8 | " | " | 4.5 | 96 | 0.07 | 5.6 | 96 | 0.09 | 5.3 | |
| 9 | 1.0 | " | 5.5 | 90 | 0.05 | 8.5 | 67 | 0.18 | 5.1 | |
| 10 | " | " | 5.0 | 90 | 0.05 | 8.5 | 71 | 0.15 | 5.5 | |
| 11 | " | " | 4.8 | 90 | 0.05 | 8.7 | 87 | 0.06 | 8.4 | The present invention |
| 12 | " | " | 4.5 | 90 | 0.05 | 8.7 | 90 | 0.05 | 8.6 | The present invention |
| 13 | 10.0 | " | 5.5 | 84 | 0.04 | 9.7 | 62 | 0.13 | 5.6 | |
| 14 | " | " | 5.0 | 84 | 0.04 | 9.8 | 68 | 0.12 | 6.0 | |
| 15 | " | " | 4.8 | 82 | 0.04 | 9.8 | 79 | 0.05 | 9.5 | The present invention |
| 16 | " | " | 4.5 | 82 | 0.04 | 9.8 | 82 | 0.04 | 9.5 | The present invention |

TABLE 2

| Sample No. | Amount of rhodium compound ($\times 10^{-8}$ mol) | Sensitizing dye | pH of emulsion as finished | Just after preparation of emulsion | | | 12 hours after preparation of emulsion | | | |
|---|---|---|---|---|---|---|---|---|---|---|
| | | | | Sensitivity | Fog | r | Sensitivity | Fog | r | |
| 17 | 0 | (6) | 5.5 | 100 | 0.46 | 4.1 | 82 | 0.72 | 2.8 | |
| 18 | " | " | 5.0 | 100 | 0.44 | 4.0 | 87 | 0.67 | 2.8 | |
| 19 | " | " | 4.8 | 100 | 0.41 | 4.0 | 97 | 0.49 | 3.4 | |
| 20 | " | " | 4.5 | 100 | 0.40 | 4.0 | 98 | 0.42 | 3.8 | |
| 21 | 0.1 | " | 5.5 | 97 | 0.36 | 5.6 | 72 | 0.56 | 4.0 | |
| 22 | " | " | 5.0 | 97 | 0.34 | 5.7 | 76 | 0.50 | 4.3 | |
| 23 | " | " | 4.8 | 95 | 0.32 | 5.7 | 89 | 0.44 | 4.8 | |
| 24 | " | " | 4.5 | 95 | 0.31 | 5.7 | 92 | 0.36 | 4.6 | |
| 25 | 1.0 | " | 5.5 | 86 | 0.12 | 7.8 | 62 | 0.24 | 5.6 | |
| 26 | " | " | 5.0 | 86 | 0.12 | 7.8 | 69 | 0.19 | 6.3 | |
| 27 | " | " | 4.8 | 85 | 0.10 | 7.6 | 82 | 0.13 | 7.4 | The present invention |
| 28 | " | " | 4.5 | 85 | 0.10 | 7.5 | 83 | 0.11 | 7.4 | The present invention |
| 29 | 10.0 | " | 5.5 | 71 | 0.09 | 9.1 | 60 | 0.17 | 6.7 | |
| 30 | " | " | 5.0 | 71 | 0.09 | 9.1 | 63 | 0.15 | 7.3 | |
| 31 | " | " | 4.8 | 71 | 0.09 | 9.0 | 70 | 0.12 | 8.7 | The present invention |
| 32 | " | " | 4.5 | 71 | 0.09 | 9.0 | 70 | 0.11 | 8.8 | The present invention |

TABLE 3

| Sample No. | Amount of rhodium compound ($\times 10^{-8}$ mol) | Sensitizing dye | pH of emulsion as finished | Just after preparation of emulsion | | | 12 hours after preparation of emulsion | | | |
|---|---|---|---|---|---|---|---|---|---|---|
| | | | | Sensitivity | Fog | r | Sensitivity | Fog | r | |
| 33 | 0 | (14) | 5.5 | 100 | 0.10 | 4.4 | 69 | 1.03 | 3.2 | |
| 34 | " | " | 5.0 | 100 | 0.10 | 4.4 | 72 | 0.62 | 3.3 | |
| 35 | " | " | 4.8 | 100 | 0.10 | 4.4 | 89 | 0.37 | 3.8 | |
| 36 | " | " | 4.5 | 100 | 0.10 | 4.4 | 97 | 0.14 | 4.2 | |
| 37 | 0.1 | " | 5.5 | 97 | 0.09 | 6.3 | 65 | 0.83 | 5.1 | |
| 38 | " | " | 5.0 | 96 | 0.09 | 6.3 | 78 | 0.44 | 5.4 | |
| 39 | " | " | 4.8 | 96 | 0.09 | 6.4 | 92 | 0.24 | 5.9 | |
| 40 | " | " | 4.5 | 96 | 0.09 | 6.3 | 94 | 0.14 | 6.0 | |
| 41 | 1.0 | " | 5.5 | 89 | 0.06 | 9.2 | 62 | 0.23 | 6.8 | |
| 42 | " | " | 5.0 | 89 | 0.06 | 9.2 | 76 | 0.18 | 7.5 | |
| 43 | " | " | 4.8 | 89 | 0.06 | 9.2 | 88 | 0.07 | 8.9 | The present invention |
| 44 | " | " | 4.5 | 89 | 0.06 | 9.2 | 89 | 0.06 | 9.0 | The present invention |
| 45 | 10.0 | " | 5.5 | 80 | 0.05 | 9.9 | 55 | 0.17 | 7.0 | |
| 46 | " | " | 5.0 | 80 | 0.05 | 9.9 | 68 | 0.12 | 7.8 | |
| 47 | " | " | 4.8 | 79 | 0.05 | 9.9 | 78 | 0.05 | 9.5 | The present invention |

TABLE 3-continued

| Sample No. | Amount of rhodium compound ($\times 10^{-8}$ mol) | Sensitizing dye | pH of emulsion as finished | Just after preparation of emulsion: Sensitivity | Fog | r | 12 hours after preparation of emulsion: Sensitivity | Fog | r | |
|---|---|---|---|---|---|---|---|---|---|---|
| 48 | " | " | 4.5 | 79 | 0.05 | 9.9 | 78 | 0.05 | 9.6 | The present invention |

As is clear from Tables 1–3, when the emulsion to which the water-soluble rhodium compound was added in an amount of $1\times10^{-8}$ mol or more per 1 mol of silver and which had a pH of 4.8 or less as finished was coated, the resulting light-sensitive materials were high in sensitivity, less in fog formation, high in contrast and high in time stability.

EXAMPLE 2

Emulsions were prepared in the same manner as in Example 1 and the dyes shown in Tables 4–5 were added thereto. In the same manner as in Example 1, samples were prepared and subjected to photographic processing and the characteristics were obtained. Comparative samples were prepared similarly using the following sensitizing dye (A). The results are shown in Tables 4–5. The sensitivity is shown as a relative value in the same manner as in Tables 1–3.

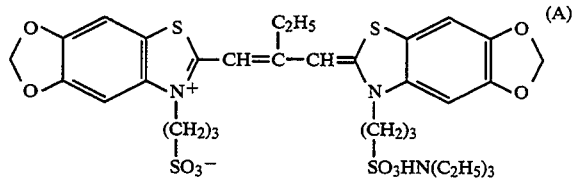

TABLE 4

| Sample No. | Amount of rhodium compound ($\times 10^{-8}$ mol) | Sensitizing dye | pH of emulsion as finished | Just after preparation of emulsion: Sensitivity | Fog | r | 12 hours after preparation of emulsion: Sensitivity | Fog | r | |
|---|---|---|---|---|---|---|---|---|---|---|
| 1 | 0 | (2) | 5.5 | 100 | 0.33 | 4.4 | 86 | 0.39 | 3.4 | |
| 2 | " | " | 4.5 | 100 | 0.31 | 4.4 | 97 | 0.32 | 3.9 | |
| 3 | 0.1 | " | 5.5 | 92 | 0.13 | 5.7 | 82 | 0.19 | 5.1 | |
| 4 | " | " | 4.5 | 92 | 0.12 | 5.7 | 90 | 0.15 | 5.5 | |
| 5 | 2.0 | " | 5.5 | 85 | 0.04 | 7.8 | 74 | 0.06 | 6.1 | |
| 6 | " | " | 4.5 | 84 | 0.04 | 7.8 | 84 | 0.05 | 7.4 | The present invention |
| 7 | 0 | (10) | 5.5 | 100 | 0.13 | 4.5 | 78 | 0.18 | 3.6 | |
| 8 | " | " | 4.5 | 100 | 0.13 | 4.5 | 96 | 0.15 | 4.1 | |
| 9 | 0.1 | " | 5.5 | 90 | 0.08 | 6.7 | 78 | 0.17 | 4.3 | |
| 10 | " | " | 4.5 | 89 | 0.08 | 6.7 | 93 | 0.10 | 5.8 | |
| 11 | 2.0 | " | 5.5 | 81 | 0.03 | 7.9 | 80 | 0.07 | 6.8 | |
| 12 | " | " | 4.5 | 81 | 0.03 | 7.9 | 80 | 0.04 | 7.7 | The present invention |
| 13 | 0 | (12) | 5.5 | 100 | 0.15 | 4.8 | 77 | 0.34 | 3.6 | |
| 14 | " | " | 4.5 | 100 | 0.14 | 4.8 | 86 | 0.24 | 4.0 | |
| 15 | 0.1 | " | 5.5 | 87 | 0.09 | 7.4 | 76 | 0.29 | 6.5 | |
| 16 | " | " | 4.5 | 87 | 0.09 | 7.4 | 82 | 0.11 | 6.7 | |
| 17 | 2.0 | " | 5.5 | 80 | 0.05 | 9.1 | 67 | 0.17 | 6.2 | |
| 18 | " | " | 4.5 | 80 | 0.05 | 9.1 | 80 | 0.06 | 8.8 | The present invention |

TABLE 4

| Sample No. | Amount of rhodium compound ($\times 10^{-8}$ mol) | Sensitizing dye | pH of emulsion as finished | Just after preparation of emulsion: Sensitivity | Fog | r | 12 hours after preparation of emulsion: Sensitivity | Fog | r | |
|---|---|---|---|---|---|---|---|---|---|---|
| 19 | 0 | (16) | 5.5 | 100 | 0.09 | 4.1 | 58 | 0.17 | 3.2 | |
| 20 | " | " | 4.5 | 100 | 0.09 | 4.0 | 96 | 0.11 | 3.9 | |
| 21 | 0.1 | " | 5.5 | 94 | 0.07 | 6.8 | 50 | 0.15 | 4.4 | |
| 22 | " | " | 4.5 | 94 | 0.07 | 6.9 | 92 | 0.10 | 6.3 | |
| 23 | 2.0 | " | 5.5 | 80 | 0.03 | 8.8 | 45 | 0.09 | 6.7 | |
| 24 | " | " | 4.5 | 80 | 0.03 | 8.8 | 80 | 0.04 | 8.6 | The present invention |
| 25 | 0 | (18) | 5.5 | 100 | 0.14 | 5.0 | 66 | 0.56 | 3.9 | |
| 26 | " | " | 4.5 | 100 | 0.14 | 5.0 | 98 | 0.15 | 4.5 | |
| 27 | 0.1 | " | 5.5 | 92 | 0.08 | 6.8 | 65 | 0.48 | 4.7 | |
| 28 | " | " | 4.5 | 92 | 0.08 | 6.8 | 90 | 0.10 | 6.8 | |
| 29 | 2.0 | " | 5.5 | 81 | 0.04 | 8.5 | 55 | 0.18 | 6.1 | |
| 30 | " | " | 4.5 | 81 | 0.04 | 8.5 | 81 | 0.05 | 8.1 | The present invention |
| 31 | 0 | (A) | 5.5 | 100 | 0.18 | 3.8 | 100 | 0.18 | 3.8 | |
| 32 | " | " | 4.5 | 100 | 0.18 | 3.8 | 100 | 0.18 | 3.8 | |
| 33 | 0.1 | " | 5.5 | 90 | 0.11 | 5.9 | 91 | 0.12 | 5.7 | |
| 34 | " | " | 4.5 | 90 | 0.11 | 5.9 | 90 | 0.11 | 5.6 | |
| 35 | 2.0 | " | 5.5 | 78 | 0.07 | 8.1 | 80 | 0.09 | 7.9 | |
| 36 | " | " | 4.5 | 78 | 0.07 | 8.1 | 78 | 0.07 | 7.9 | |

As is clear from Tables 4–5, when the emulsion which contained the sensitizing dye of the present invention and contained the water-soluble rhodium compound and which had a pH of 4.8 or less as finished was coated, the resulting light-sensitive materials were high in sensitivity, less in fog formation, high in contrast and high in time stability.

As can be seen from Examples, the present invention provides silver halide photographic light-sensitive materials high in sensitivity and contrast for high-intensity red light sources and excellent in time stability.

What is claimed is:

1. A silver halide photographic light-sensitive material comprising a support and at least one silver halide emulsion layer provided on the support wherein said light-sensitive material is produced by the process comprising the following steps:

preparing a silver halide emulsion which comprises 50 mol % or more of silver chloride and $5\times10^{-9}$ mol or more of a water-soluble rhodium compound per 1 mol of silver and at least one sensitizing dye represented by the following formula (I);

adjusting the pH of said emulsion as finished to be 4.8 or less; and coating said silver halide emulsion on said support:

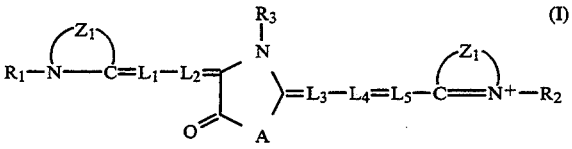

(I)

wherein $L_1$, $L_2$, $L_3$, $L_4$ and $L_5$ each represents a methine group; A represents O or S; $Z_1$ and $Z_2$ may be identical or different and each represents a group of non-metallic atoms necessary to complete a thiazole nucleus, a thiazoline nucleus, an oxazole nucleus or a selenazole nucleus; $R_1$ and $R_2$ each represents an alkyl group of 1 to 4 carbon atoms or an alkyl group of 1 to 4 carbon atoms which is substituted with an acid or an acid salt; $R_3$ represents an alkyl group of 1 to 6 carbon atoms which may be substituted with an acid group, an aryl group or a heterocyclic ring.

2. A silver halide photographic light-sensitive material according to claim 1 wherein an aqueous silver nitrate solution is employed in the step of preparing said silver halide emulsion and said sensitizing dye is present in an amount of 0.01–10 g based on 1 kg of silver nitrate.

3. A silver halide photographic light-sensitive material according to claim 1 wherein the water-soluble rhodium compound is a water-soluble trivalent rhodium compound.

4. A silver halide photographic light-sensitive material according to claim 1 wherein the amount of the water-soluble rhodium compound is $2\times10^{-8}$-$1\times10^{-6}$ mol based on 1 mol of the silver halide.

5. A silver halide photographic light-sensitive material according to claim 1 wherein the silver halide emulsion comprises 70 mol % or more of silver chloride.

6. A silver halide photographic light-sensitive material according to claim 1 wherein the silver halide emulsion is chemically sensitized with sulfur and gold sensitizers.

* * * * *